US005191871A

United States Patent [19]

Liskow

[11] Patent Number: 5,191,871

[45] Date of Patent: Mar. 9, 1993

[54] APPARATUS FOR INJECTING A FUEL-GAS MIXTURE

[75] Inventor: Uwe Liskow, Kornwestheim, Fed. Rep. of Germany

[73] Assignee: Robert Bosch GmbH, Stuttgart, Fed. Rep. of Germany

[21] Appl. No.: 781,161

[22] PCT Filed: Feb. 23, 1991

[86] PCT No.: PCT/DE91/00153

§ 371 Date: Nov. 8, 1991

§ 102(e) Date: Nov. 8, 1991

[87] PCT Pub. No.: WO91/14093

PCT Pub. Date: Sep. 19, 1991

[51] Int. Cl.[5] ..... F02M 69/08; F02M 69/04; F02M 61/14; F02M 61/18

[52] U.S. Cl. ..... 123/531; 123/468; 239/407

[58] Field of Search ..... 123/445, 531, 533, 468, 123/472; 239/407

[56] References Cited

U.S. PATENT DOCUMENTS

| | | | |
|---|---|---|---|
| 4,570,598 | 2/1986 | Samson et al. | 123/445 |
| 4,690,118 | 9/1987 | Hofbauer et al. | 123/533 |
| 4,708,117 | 11/1987 | Mesenich et al. | 123/533 |
| 4,909,220 | 3/1990 | Field et al. | 123/468 |

*Primary Examiner*—Tony M. Argenbright

*Attorney, Agent, or Firm*—Edwin E. Greigg; Ronald E. Greigg

[57] ABSTRACT

An apparatus for injecting a fuel-gas mixture into the mixing lines of a mixing housing, so that a maximally homogeneous fuel-gas mixture is assured. The fuel is injected in an oriented fashion for the injection ports directly into the mixing lines in an accurate fuel distribution to the various mixing lines in a maximally homogenous mixture formation. From a central gas delivery line, the gas reaches each mixing line via a respective gas conduit. Via the mixture injection lines, the mixture is delivered to the cylinders or injection groups of an internal combustion engine.

18 Claims, 3 Drawing Sheets

APPARATUS FOR INJECTING A FUEL-GAS MIXTURE

BACKGROUND OF THE INVENTION

The invention is based on an apparatus for injecting a fuel-gas mixture as set forth hereinafter. In German Patent Application P 39 31 490.1, an apparatus for injecting a fuel-gas mixture has already been proposed that has a mixing housing that has a recess, a central gas delivery line, and a number of mixing lines corresponding to the number of injection ports of the valve head. However, the fuel stream is injected into the mixing lines from the injection ports not directly but rather in the form of a free stream, so that the danger exists that a fuel film will form in the mixing housing on the walls defining the recess; this prevents the formation of a largely homogeneous fuel-gas mixture. The large cross sections of the recess of the mixing housing in the region of the injection ports and mixing lines do not allow high gas speeds in these regions, so fuel injected from the injection ports can get into the gas delivery line, especially if the fuel injection valve is installed in an inclined position. Fuel can become deposited in the corners or edges formed in the recess and can lead to continued dribbling, after shutoff of the fuel injection valve, for instance, which can be a problem.

Reliable, exact fuel metering to the various mixing lines and thus to the various cylinders of an internal combustion engine is therefore not always assured by the apparatus proposed in German Patent Application P 39 31 490.1.

ADVANTAGES OF THE INVENTION

The apparatus according to the invention for injecting a fuel-gas mixture, has the advantage over the prior art of particularly accurate fuel distribution to the various mixing lines and cylinders of an internal combustion engine, and of maximally homogenous mixture formation. The oriented fuel stream is injected from the injection ports directly into the mixing lines and is transported onward all the way downstream by means of the gas carried by the gas conduits, preventing the formation of a fuel film on the walls of the mixing lines. Virtually no corners, edges or gaps where fuel can become deposited are formed in the mixture formation zone, in the region of the mixing line oriented toward the injection port; after the shutoff of the fuel injection valve, for instance, such deposits could lead to problematic further dribbling and nonhomogeneous formation of the fuel-gas mixture.

Advantageous further features of and improvements to the apparatus defined herein are possible with the provisions set forth.

The narrow embodiment of the gas conduit results in acceleration of the gas, fine atomization of the fuel, and thus improved mixing of gas and fuel. The high gas speed and the reduction of pressure in the mixing lines prevent the formation of a mist or film of fuel in the gas delivery line.

It is particularly advantageous if the gas conduits are embodied between the valve head and the mixing housing; this makes the gas conduits discharging directly into the mixing line simple to manufacture.

It is advantageous if the gas conduits are either formed in the mixing housing and defined by the bearing face of the valve head, or formed in the valve head and defined by the contacting surface of the mixing housing, so that the grooves that form the gas conduits need to be disposed either in the mixing housing only or in the valve housing only, which reduces manufacturing costs.

However, it is also advantageous if the gas conduits that connect the gas delivery line to the mixing lines are embodied as bores, which are easy to manufacture.

It is advantageous if the gas conduits extend as far as the injection ports, so that the injected fuel is transported all the way downstream, without the danger of fuel getting into the gas conduits.

As an alternative to a constant cross-sectional area of the gas conduits, it is especially advantageous if the gas conduits have a varying cross-sectional area, so that the location of gas expansion or throttling is at a point between the gas delivery line and the mixing lines in the gas conduits.

For metering and accelerating the gas serving the purpose of mixture formation, it is advantageous if the gas conduits are embodied in a throttling manner, and/or if the gas conduits and the mixing lines overlap one another in such a way as to produce throttling.

For problem-fuel free injection of fuel into the mixing lines, it is advantageous if the diameter of the mixing lines is greater than the diameter of the injection ports.

It is advantageous if the gas conduits discharge into the mixing lines at a tangent, so that a swirl that improves the mixture formation is developed.

A conically extending contact face of the valve head that rests on the likewise conically extending bearing face of the mixing housing has the advantage of particularly simple centering of the fuel injection valve in the valve holder of the mixing housing.

In terms of the production costs of the apparatus according to the invention, however, it is also advantageous if the valve head has a flat contact face, which rests on the likewise flat bearing face of the mixing housing.

It is especially advantageous if the mixing housing is embodied of a plastic, which makes for economical manufacture.

In this connection, it is advantageous if the mixing housing is attached to the valve head of the fuel injection valve by being spray-coated around it, thereby producing a firm connection between the mixing housing and the fuel injection valve.

If the mixing housing is embodied of a metal material, then it is advantageous if the valve head of the fuel injection valve is firmly joined to the mixing housing by means of a welded seam.

It is also advantageous if the mixing housing, embodied as an arbitrary material, is firmly joined to the valve head of the fuel injection valve by means of an adhesive bond.

DRAWING

Exemplary embodiments of the invention are shown in simplified form in the drawing and described in further detail in the ensuing description.

DESCRIPTION OF THE EXEMPLARY EMBODIMENTS

Figure 1:
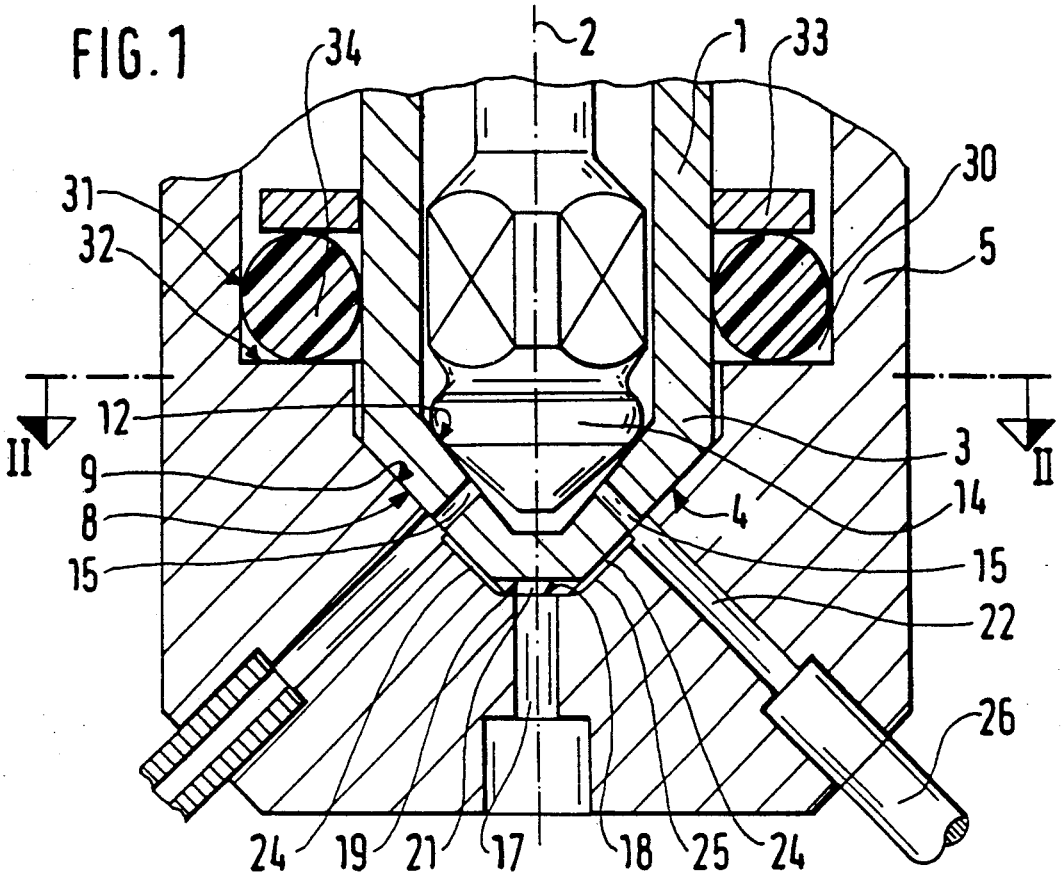
FIG. 1 shows a first exemplary embodiment with a fuel injection valve shown in fragmentary form.

The apparatus, shown in fragmentary form on longitudinal section by way of example in FIG. 1, for injecting a fuel-gas mixture into an intake tube of an internal combustion engine or directly into the cylinders of the engine, has a fuel injection valve 1 circumferentially engaged by its valve head 3, which is embodied as concentric with a longitudinal valve axis 2, of a valve holder 4, which is embodied in a stepped longitudinal bore, of a mixing housing 5. The valve head 3 of the fuel injection valve 1 rests with a conical extending contact face 8 on a bearing face 9, extending conically and parallel to it, of the valve holder 4, resulting in simple, yet highly accurate, automatic centering of the fuel injection valve 1 in the valve holder 4 of the mixing housing 5. The fuel injection valve 1 has a valve closing body 14 that cooperates with a fixed valve seat 12. Downstream of the valve seat 12, the valve head 3 of the fuel injection valve 1 has a number of injection ports 15, for example four, and corresponding to the number of engine cylinders or engine injection groups, each group encompassing a plurality of cylinders.

The mixing housing 5 has a gas delivery line 17 extending concentrically with the longitudinal valve axis 2; this line discharges at an end face 18 of the valve housing 4, into a distributor chamber 21 formed in the axial direction between the end face 18 and the end face 19 of the frustoconical valve head 3.

In alignment with the injection ports 15 of the valve head 3, in the mixing housing 5, there are a number of mixing lines 22, corresponding to the number of injection ports 15 and communicating with the injection ports 15. One gas conduit 24, which joins the distributor chamber 21 to the mixing line 22, extends from the distributor chamber 21 to each mixing line 22. The distributor chamber 21 enables a uniform flow of the gas through the gas conduit 24. The gas conduits 24 are embodied in the bearing face 9 of the valve holder 4, for instance in the form of grooves 25 having a constant cross-sectional area that are open at the top and have rectangular cross-sectional shape, for example, and are defined by the contact face 8 of the valve head 3. Since the gas conduits 24 have a substantially smaller cross-sectional area, compared with the gas delivery line 17 and the distributor chamber 21, the delivered gas quantity is throttled and thus metered to the various gas conduits 24. At the same time, the cross-sectional reduction accelerates the gas, so that when it reaches the mixing line 22, it strikes the fuel, injected from the injection ports 15, at high speed. First, this provision makes the formation of a maximally homogenous fuel-gas mixture easier, and second, the fuel, injected from the injection ports, is transported onward all the way downstream, so that it cannot pass through the gas conduits 24 upstream to reach the distributor chamber 21 and the gas delivery line 17. The fuel-gas mixture is transported via the mixing lines 22 and adjoining mixture injection lines 26 to the intake tube or directly into the engine cylinders and injected there.

In throttling the gas, however, it must be taken into account that a severely throttled gas flow, upon expansion in the mixing line 22, can affect the fuel quantity injected through the injection ports 15.

By way of example, the gas is air, diverted through a bypass upstream of a throttle valve in the intake tube of the engine; recirculated engine exhaust gas, to reduce toxic emissions, or a gas delivered by a supplementary blower is also possible, however.

The valve head 3 is sealed off from the valve holder 4 of the mixing housing 5 in a fluid-tight manner. To this end, an annular chamber 30 is provided, its axial defining faces being embodied by the circumference of the valve head 3 and by a parallel portion 31 of the valve holder remote from the gas delivery line 17, and its radial limiting faces being embodied by a receiving shoulder 32 of the valve holder 4, embodied vertically of the longitudinal valve axis 2, and by a retaining ring 33, which for instance is secured to the circumference of the valve head 3. A sealing ring 34, for instance, is disposed in the annular chamber 30.

Figure 2:
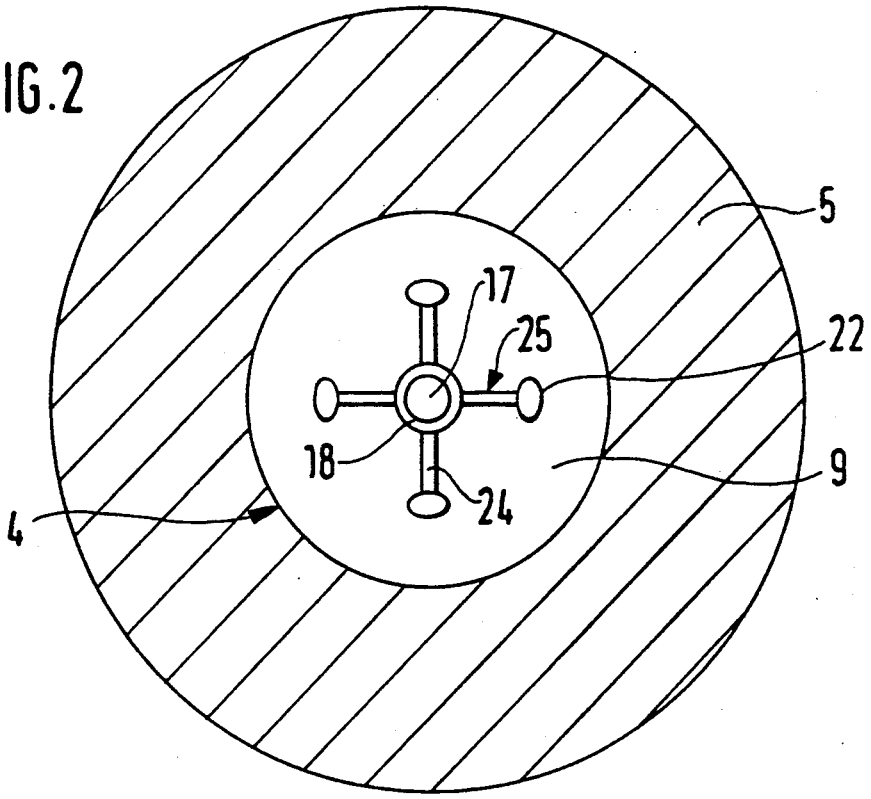
FIG. 2 is a section taken along the line II—II of FIG. 1 without the fuel injection valve.

FIG. 2 is a section taken along the line II—II of FIG. 1; in this view, the fuel injection valve 1 has not been shown. In addition to the radial mouths of the gas conduits 24 into the mixing lines 22 shown here, however, it is also possible for the gas conduits 24 to discharge into the mixing lines 22 at a tangent, creating a swirl in the mixing lines 22 that improves the mixture formation. Instead of the rectangular cross-sectional shape shown, the grooves 25 forming the gas conduits may also have some other cross-sectional shape, such as semicircular.

Figure 3:
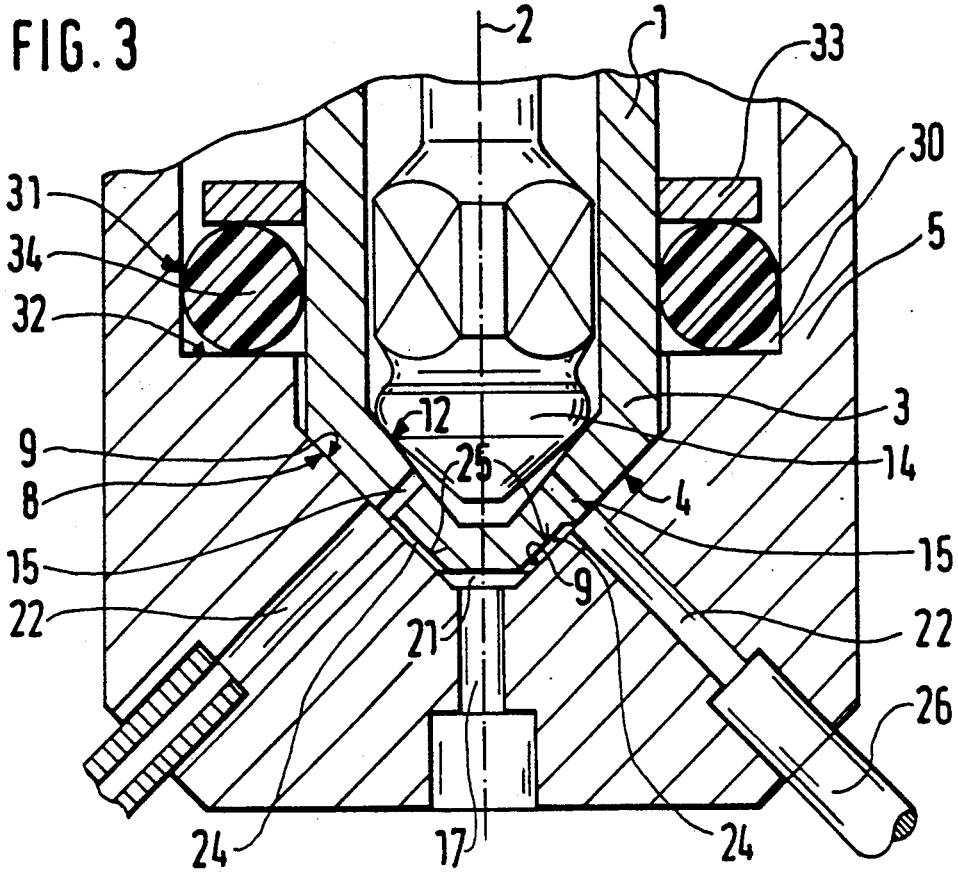
FIG. 3 shows a second exemplary embodiment on the left and a third exemplary embodiment on the right.

In FIG. 3, a second exemplary embodiment is shown on the left-hand side of the longitudinal valve axis 2, and a third exemplary embodiment is shown on the right-hand side of the longitudinal valve axis 2. Elements that are the same and function the same are identified by substantially the same reference numerals as in FIGS. 1 and 2. In both the second and third exemplary embodiments, the gas conduits 24 in the valve head 3 of the fuel injection valve 1 are embodied in the form of grooves 25 and are defined by the bearing face 9 of the mixing housing 5. In the second exemplary embodiment, the gas conduit 24 discharges directly into the injection port 15 of the valve head 3, so that at the transition from the gas delivery line 17 or from the distributor chamber 21 to the gas conduit 24, the gas undergoes throttling and thus both metering and acceleration.

The third exemplary embodiment shows another way of throttling the delivered gas. The cross-sectional area of the gas conduits 24 is substantially greater than in the first two exemplary embodiments, so that at the transition of the gas from the distributor chamber 21 or gas delivery line 17 into the gas conduits 24, no substantial throttling occurs. The actual throttling and thus both the metering and acceleration of the delivered gas is attained by means of the partial overlap of the gas conduits 24 and mixing lines 22; the gas conduits 24 do not discharge into the injection ports 15 of the valve head 3.

Figure 4:
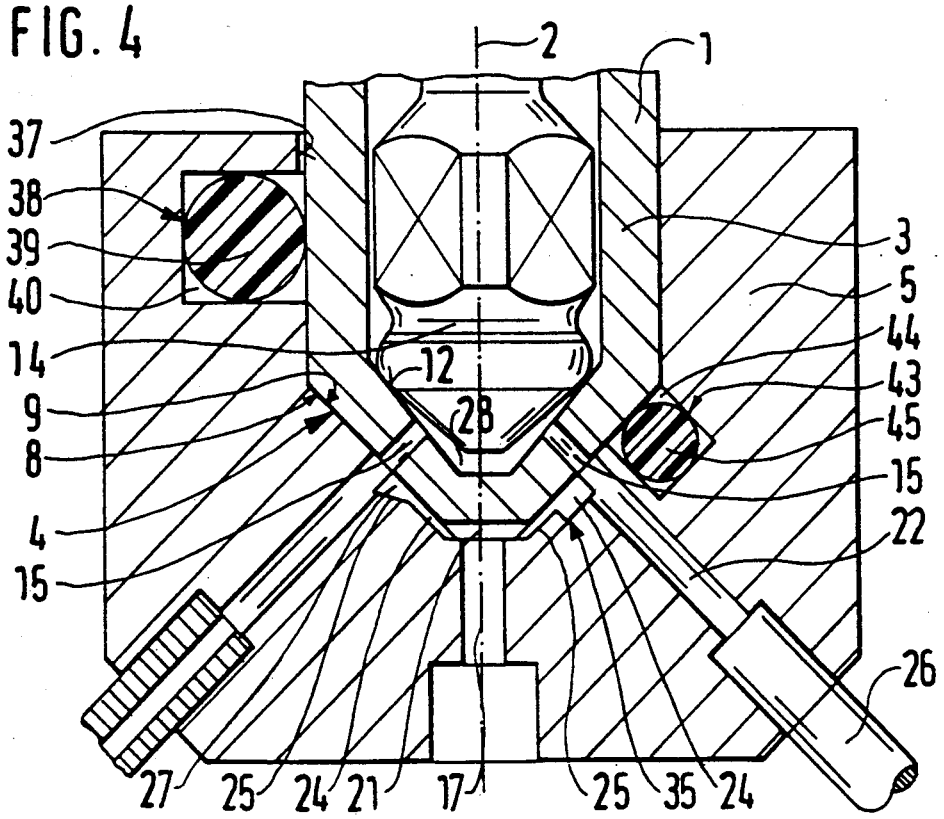
FIG. 4 shows a fourth exemplary embodiment on the left and a fifth exemplary embodiment on the right.

Other possibilities for sealing off the valve head 3 of the fuel injection valve 1 from the valve holder 4 of the mixing housing 5, along with other cross-sectional shapes of the gas conduit 24 and groove 25 are shown in FIG. 4, in which the elements that are the same and function the same are identified by substantially the same reference numerals as in FIGS. 1–3. The gas conduits 24 are for instance embodied in a mixing housing 5. In a fourth exemplary embodiment, which is shown on the left-hand side of the longitudinal valve axis 2 of FIG. 4, an annular groove 38, which serves as a receptacle for a sealing ring 39, is embodied in the parallel portion 37 of the valve holder 4. Parallel to the longitudinal valve axis 2, the annular groove 38 is defined by the circumference of the valve head 3, so that a chamber 40 is created.

The gas conduit 24 and the groove 25, in the region oriented toward the mixing line 22, have a cross-sectional area that increases continuously and takes the form of a diffusor 27. The location of gas expansion is thus at a point between the beginning of the gas conduit 24 at the gas delivery line 17 and the end of the gas conduit 24 at the mixing line 22, so that the fuel stream is injected not directly into the expanding airflow but rather into a calmer flow. If the injection port 15 is located directly at the mouth of the gas conduit 24 into the mixing line 22, where the expansion occurs, the danger otherwise may possibly exist that the gas flow, by the jet effect, aspirates fuel from an idle volume 28 of the fuel injection valve 1. The idle volume 28 is formed downstream of the valve seat face 12 between the circumference of the valve closing body 14 and the inner wall of the valve head 3.

It is also possible, however, for the cross-sectional area of the gas conduit 24 or groove 25, between the beginning and end of the gas conduit, to take the form of a nozzle, or for instance, as shown in a fifth exemplary embodiment on the right-hand side of the longitudinal valve axis 2 in FIG. 4, the form of a cross-sectional discontinuity 35 that abruptly widens the cross-sectional area in the flow direction.

The fifth exemplary embodiment also shows another possibility for sealing off the valve head 3 from the valve holder 4. An annular groove 43 formed in the conically extending bearing face 9 of the mixing housing 5, and together with the conically extending contact face 8 of the valve head 9, this groove forms an annular chamber 44, in which a sealing ring 45 is for instance disposed.

Another possibility is to embody the annular groove 43 in the contact face 8 of the valve head 3, so that the annular chamber 44 is created by it together with the bearing face 9 of the mixing housing 5.

In a departure from the rectangular cross sections of the annular grooves 38, 43 shown in the exemplary embodiments, however, it is also possible if the annular groove 38, 43 has some other cross section, for instance semicircular.

Figure 5:
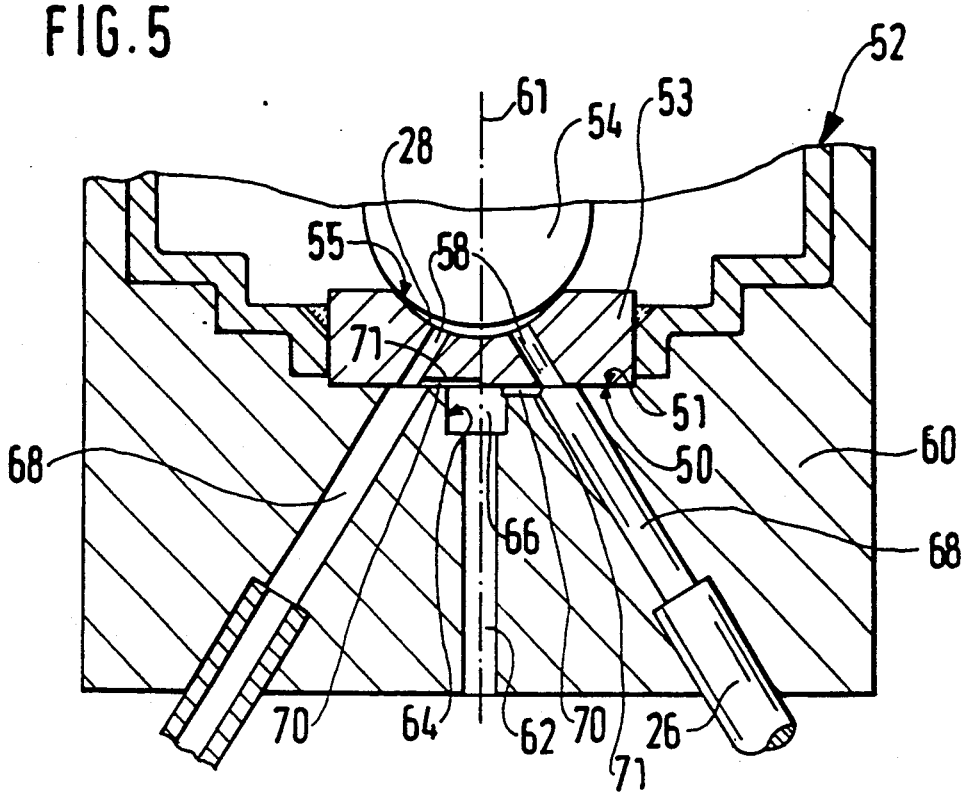
FIG. 5 shows a sixth and a seventh exemplary embodiment.

As an alternative to the exemplary embodiments shown in FIGS. 1–4, which have a conically extending contact face 8 of the valve head 3 and a conically extending bearing face 9 of the valve holder 4 of the mixing housing 5, however, it is also possible, as a sixth and second exemplary embodiment in FIG. 5 show, for a contact face 59 of a valve head 53 and a bearing face 51 of a mixing housing 60 to be embodied as flat. A fuel injection valve 52 has a valve closing body 54, which cooperates with a fixed valve seat 55 embodied on its head 53, downstream of which valve seat 4 injection ports 58, for instance, are provided. The mixing housing 60 has a gas delivery line 62 that extends concentrically with a longitudinal valve axis 61 and has an enlarged inside diameter 64 on its end toward the valve head 53. Together with the bearing face 50 of the valve head 53, this forms a distributor chamber 66. In alignment with the injection ports 58 of the valve head 53, mixing lines 68 are formed in the mixing housing 60 that communicate with the injection ports 58 and correspond with them in number. From the distributor chamber 66, one gas conduit 70 leads to each mixing line 68 and connects the distributor chamber 66 with the mixing line 68. In the sixth exemplary embodiment, shown on the left-hand side of the longitudinal valve axis 2, the gas conduit 70 is embodied in the form of a groove 71 in the contact face 50 of the valve head 53 and is defined by the bearing face 51 of the mixing housing 60 and discharges directly into the injection port 58. On the right-hand side of the longitudinal valve axis 61, in the seventh exemplary embodiment, the gas conduit 70 is embodied in the bearing face 51 of the mixing housing 60 and defined by the contact face 50 of the valve head 53, so that the gas conduit 70 discharges into the mixing line 68. In both exemplary embodiments, the throttling, metering and acceleration of the gas are produced at the transition of the gas from the distributor chamber 66 into the narrow gas conduit 70.

Figure 6:
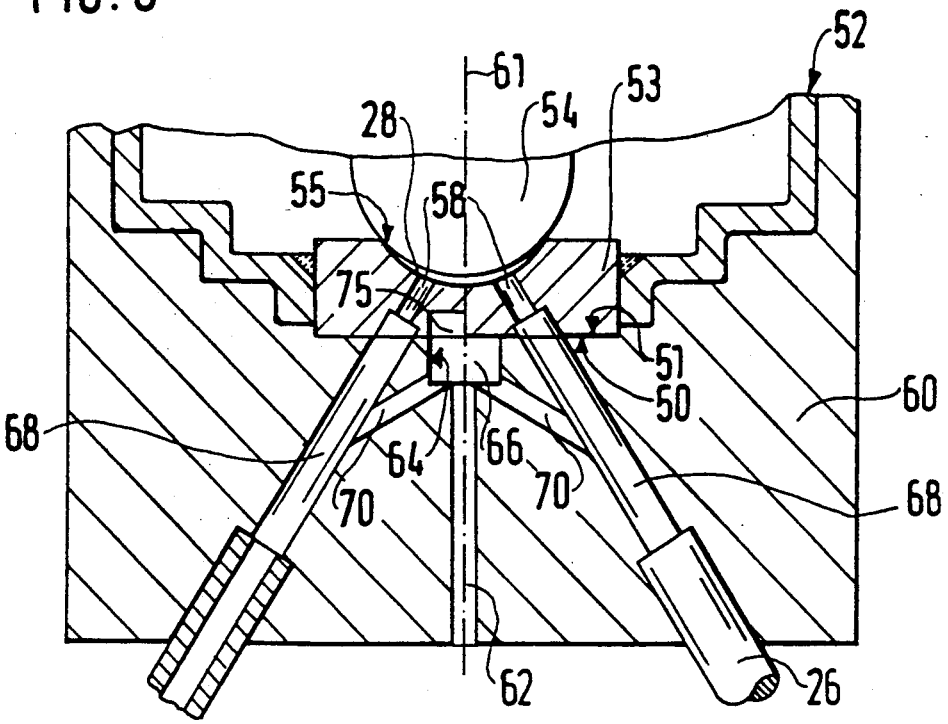
FIG. 6 shows an eighth and a ninth exemplary embodiment.

FIG. 6 shows an eighth exemplary embodiment of the invention on the left-hand side of the longitudinal valve axis 61 and a ninth exemplary embodiment on the right-hand side of the longitudinal valve axis 61; in them, elements that are the same and function the same are identified by substantially the same reference numerals as in FIG. 5.

The mixing housing 60 has the central gas delivery line 62, which on its end toward the valve head 53 has an enlarged inside diameter 64. Along with a recess 75 in the contact face 50 of the valve head 53, this forms the distributor chamber 66 in the eighth exemplary embodiment. In the ninth exemplary embodiment, contrarily, the distributor chamber 66 is formed directly by the contact face 50 of the valve head 53 and the region of the enlarged inside diameter 64.

In both the eighth and the ninth exemplary embodiment, the gas delivery line 62 communicates with the various mixing lines 68 via the various gas conduits 70, for instance in the region of the distributor chamber 66. The gas conduits 70 are embodied in the form of bores extending inside the mixing housing and for instance having a constant cross-sectional area. The throttling of the gas takes place upon the inflow into the gas conduits 70 that in comparison with the gas delivery line 62 or distributor chamber 66 have a substantially smaller cross-sectional area and that cause an abrupt reduction in cross section. The expansion of the gas flow takes place at the mouth of the gas conduits 70 into the various mixing lines 68, which in both exemplary embodiments are located not directly at the injection ports 58 but rather spaced apart by a certain distance from the bearing face 51. It is practical for each of the gas conduits 70 to extend downward away from the distributor chamber 60 in an inclined fashion, so that the gas conduits 70 are oriented away from the bearing face 51. This effectively prevents the gas flow from aspirating fuel, by jet action, out of the idle volume 28 of the fuel injection valve 52.

In a mixing housing 5, 60 of a metal material, the mixing housing 5, 60 is joined to the valve head 3, 53 of the fuel injection valve 1, 52 by welding, for example. However, to reduce the production costs, it is also possible to embody the mixing housing 5, 60 of a plastic. The mixing housing 5, 60 is attached to the valve head 3, 53 of the fuel injection valve 1, 52 by spray-coating with plastic, for instance. Another possibility is to secure the mixing housing 5, 60, embodied of some arbitrary material, to the valve head 3, 53 of the fuel injection valve 1, 52 by adhesive bonding.

In the apparatuses according to the invention, shown in the exemplary embodiments, for injecting a fuel-gas mixture, the fuel is injected in oriented fashion out of the injection ports 15, 58 directly into the mixing lines 22, 68, and the gas is delivered to the various mixing lines 22, 68 for mixture formation each via a respective narrow gas conduit 24, 70. The result is both accurate fuel distribution to the various mixing lines 22, 68 and maximally homogenous mixture formation, since in addition, the high flow speed of the gas effectively prevents a flow of the fuel in the direction of the gas delivery line 17, 62.

I claim:

1. An apparatus for injecting a fuel-gas mixture, having a fuel injection valve having a longitudinal axis which has, in a valve housing, a valve closing body actuatable as a function of operating state and a number of injection ports corresponding with the number of cylinders or injection groups, each encompassing a plurality of cylinders, of an internal combustion engine, and having a mixing housing which has a gas delivery line serving to deliver gas and extending concentrically with the longitudinal valve axis and which in alignment with the injection ports has a number of mixing lines corresponding to the number of injection ports, wherein the valve head, embodied concentrically with the longitudinal valve axis, protrudes into a valve holder of the mixing housing, and the gas delivery line communicates with the mixing lines, the valve head (3, 53) rests by a contact face (8, 50) on a bearing face (9, 51) of the mixing housing (5, 60), and one gas conduit (24, 70) for each mixing line leads away from the gas delivery line (17, 62) to each of the mixing lines (22, 68), and each of the gas conduits (24, 70) has a smaller cross-sectional area in comparison with the mixing lines (22, 68).

2. An apparatus as defined in claim 1, in that the gas conduits (24, 70) are embodied between the valve head (3, 53) and the mixing housing (5, 60).

3. An apparatus as defined by claim 1, in that the gas conduits (24, 70) are embodied in the mixing housing (5, 60) and are defined by the contact face (8, 50) of the valve head (3, 53).

4. An apparatus as defined by claim 1, in that the gas conduits (24, 70) are embodied in the valve head (3, 53) and are defined by the bearing face (9, 51) of the mixing housing (5, 60).

5. An apparatus as defined in claim 1, in that the gas conduits (70) are embodied as bores.

6. An apparatus as defined by claim 2, in that he gas conduits (24–70) extend as far as the injection ports (15, 58).

7. An apparatus as defined by claim 1, in that the gas conduits (24, 70) have a varying cross-sectional area.

8. An apparatus as defined by claim 1, in that the gas conduits (24, 70) are embodied in throttling fashion for metering the gas.

9. An apparatus as defined by claim 1, in that the gas conduits (24, 70) overlap the mixing lines (22, 68) in such a way taht throttling, serving the purpose of gas metering, results.

10. An apparatus as defined by claim 1, in that the diameter of the mixing lines (22, 68) is greater than the diameter of the injection ports (15, 58).

11. An apparatus as defined by claim 1, in that the gas conduits (24, 70) discharge radially into the mixing lines (22, 68).

12. An apparatus as defined by claim 1, in that the gas conduits (24, 70) discharge at a tangent into the mixing lines (22, 68).

13. An apparatus as defined by claim 1, in that the valve head (3) has a conically extending contact face (8), which rests on the likewise conically extending bearing face (9) of the mixing housing (5).

14. An apparatus as defined by claim 1, in that the valve head (53) has a flat contact face (50), which rests on the likewise flat bearing face (51) of the mixing housing (60).

15. An apparatus as defined by claim 1, in that the mixing housing (5, 60) is embodied of a plastic.

16. An apparatus as defined by claim 16, in that the mixing housing (5, 60) is attached to the valve head (3, 53) of the fuel injection valve (1, 52) by plastic spray-coating.

17. An apparatus as defined by claim 1, characterized in that the valve head (3, 53) of the fuel injection valve (1, 52) is firmly joined to the mixing housing (5, 60) by means of a welded seam.

18. An apparatus as defined by claim 1, in that the valve head (3, 53) of the fuel injection valve (1, 52) is firmly joined to the mixing housing (5, 60) by means of an adhesive bond.

* * * * *